US005351469A

United States Patent [19]

Karolyi

[11] Patent Number: 5,351,469

[45] Date of Patent: Oct. 4, 1994

[54] SPINNING MACHINE HAVING A PLURALITY OF SPINNING UNITS AND A SERVICING APPARATUS

[75] Inventor: Oskar Karolyi, Bad Boll, Fed. Rep. of Germany

[73] Assignees: Fritz Stahlecker; Hans Stahlecker, Fed. Rep. of Germany

[21] Appl. No.: 162,793

[22] Filed: Dec. 7, 1993

Related U.S. Application Data

[63] Continuation of Ser. No. 12,372, Feb. 2, 1993, abandoned, which is a continuation of Ser. No. 507,193, Apr. 10, 1990, abandoned.

[30] Foreign Application Priority Data

Apr. 17, 1989 [DE] Fed. Rep. of Germany ..... 3912573

[51] Int. Cl.[5] ..... D01H 1/00; B65H 69/04

[52] U.S. Cl. ..... 57/22; 57/352; 242/35.60 R

[58] Field of Search ..... 57/22, 261, 263, 352; 242/35.6 R

[56] References Cited

U.S. PATENT DOCUMENTS

| | | | |
|---|---|---|---|
| 3,198,446 | 8/1965 | Fürst et al. | 242/35.6 R |
| 4,121,409 | 10/1978 | Uchida et al. | 57/22 |
| 4,292,796 | 10/1981 | Mima | 57/22 |
| 4,397,138 | 8/1983 | Rohner et al, | 57/22 |
| 4,446,687 | 5/1984 | Mima | 57/22 |
| 4,481,761 | 11/1984 | Kimura | 57/22 |
| 4,505,097 | 3/1985 | Mima | 57/22 |
| 4,538,407 | 9/1985 | Matsui et al. | 57/22 |
| 4,555,899 | 12/1985 | Mima | 57/22 |
| 4,607,482 | 8/1986 | Otoshima | 57/22 |
| 4,877,194 | 10/1989 | Matsui et al. | 57/22 X |
| 4,939,893 | 7/1990 | Fujiwara | 57/261 X |
| 4,958,486 | 9/1990 | Stahlecker | 242/35.6 R X |
| 4,964,268 | 10/1990 | Stahlecker | 57/261 |
| 4,972,668 | 11/1990 | Stahlecker | 57/22 X |

FOREIGN PATENT DOCUMENTS

| | | |
|---|---|---|
| 3004721 | 8/1982 | Fed. Rep. of Germany . |
| 2750913 | 11/1983 | Fed. Rep. of Germany . |
| 2728620 | 10/1984 | Fed. Rep. of Germany . |
| 3611050 | 10/1987 | Fed. Rep. of Germany . |

*Primary Examiner*—Daniel P. Stodola
*Assistant Examiner*—Michael R. Mansen
*Attorney, Agent, or Firm*—Evenson, McKeown, Edwards & Lenahan

[57] ABSTRACT

In a spinning machine having a plurality of spinning units arranged next to one another and having a movable servicing apparatus which can be applied to the individual spinning points for the piecing, it is provided that the servicing apparatus has a splicing device with a splicing duct directed toward the spool package. A yarn storage device is arranged approximately as an extension of the splicing duct and a guiding element of the servicing apparatus which transfers the newly spun yarn in the area of the yarn storage device can be brought between a device for the withdrawal of a yarn and devices for picking up this yarn which can be moved into the area between a spool package and the splicing device.

26 Claims, 6 Drawing Sheets

SPINNING MACHINE HAVING A PLURALITY OF SPINNING UNITS AND A SERVICING APPARATUS

This is a continuation of application Ser. No. 08/012,372, filed on Feb. 2, 1993, now abandoned, which is a continuation of application Ser. No. 07/507,193, filed Apr. 10, 1990, now abandoned.

BACKGROUND AND SUMMARY OF THE INVENTION

The invention relates to a spinning machine having a plurality of spinning units arranged next to one another which each have at least one device for spinning a yarn, one device for withdrawing a yarn, and one device for winding the yarn onto a spool. A movable servicing apparatus is provided which can be applied to the individual spinning units for piecing and comprises a splicing device for connecting a newly spun new yarn with an old yarn taken off the spool package, devices picking up the new yarn and for placing it in the splicing device, devices for picking up the old yarn and placing it in the splicing device, and a yarn storage device which can be placed between the device for the withdrawing and the splicing device.

A spinning machine of the initially mentioned type is described in German Published Examined Patent Application (DE-A) 36 11 050 in which, during a piecing operation, a newly spun double yarn is connected with an old double yarn taken off a wind-up package spool by means of splicing in a splicing device.

A semi-automatically operating machine is also known—German Patent Document (DE-C) 27 28 620—in which a newly spun single yarn is manually placed in a movable servicing apparatus. Likewise, an old yarn taken off a package spool is inserted into the servicing apparatus. The servicing apparatus is equipped with a knotting device which automatically makes a knot between the old and the new yarn. During this knotting operation, the continuously produced new yarn is sucked into a pneumatic yarn storage device.

It was known, in the case of spooling frames such as described in German Patent Documents DE-C 27 50 913 and DE-C 30 04 721, to clean out yarn defects during a rewinding operation and, in the process, establish spliced connections between the yarn withdrawn from a cop and the yarn wound onto a cross-wound package. In this type of a spooling frame, the supply of the yarn, i.e., the withdrawal of the yarn from the cop, is interrupted during the establishment of a spliced connection.

It is an object of the invention to develop a spinning machine of the initially mentioned type such that the yarns to be connected, i.e., the newly spun new yarn and the old yarn withdrawn from the package, are securely inserted into the splicing device in a specified position.

This object is achieved according to the invention in that the splicing device has a splicing duct directed toward the package, in that the yarn storage device is arranged approximately as an extension of the splicing duct, and in that a guiding element of the servicing apparatus which transfers the new yarn into the area of the yarn storage device can be moved between the device for the withdrawal of the new yarn and the devices for picking up the new yarn which can be moved into the area between the package and the splicing device.

Because of the fact that the splicing duct of the splicing device is directed toward the spool package, it is easily possible to place the old yarn picked up from the spool package in the splicing device by means of a relatively simple element for the picking-up and inserting. The devices for picking up this old yarn must only carry out a relatively simple movement, such as a swivel movement. These devices can then, in a simple manner, hold the yarn for so long in the splicing device until its elements pick up and hold the yarn. For the newly spun yarn, the yarn storage device acts as a holding element which, in connection with the devices for picking up the new yarn, provides that the new yarn is also inserted securely and in a defined manner in the splicing device.

In a further development of the invention, guiding elements of the servicing apparatus for the old yarn withdrawn from the spool package are provided between the spool package and the splicing device, these guiding elements being movable transversely with respect to the splicing duct. As a result, it becomes possible to take into account the fact that the old yarn is withdrawn from the cross-wound package, in which case, its withdrawal point in practice may be any point of the axial length of the spool package. By means of the guiding elements, it is ensured that the yarn nevertheless securely reaches the splicing duct. In an advantageous development, two guiding fingers are provided which are arranged essentially in a V-shape on a common shaft extending in parallel with respect to the splicing duct, these guiding fingers being pivoted by means of driving elements. These guiding fingers are used not only for guiding the old yarn coming from the spool package securely into the splicing device, but also for placing the old yarn such that after the splicing and the subsequent rewithdrawal, it cannot become hung up at other elements.

Other objects, advantages and novel features of the present invention will become apparent from the following detailed description of the invention when considered in conjunction with the accompanying drawings.

DETAILED DESCRIPTION OF THE DRAWINGS

Figure 1:
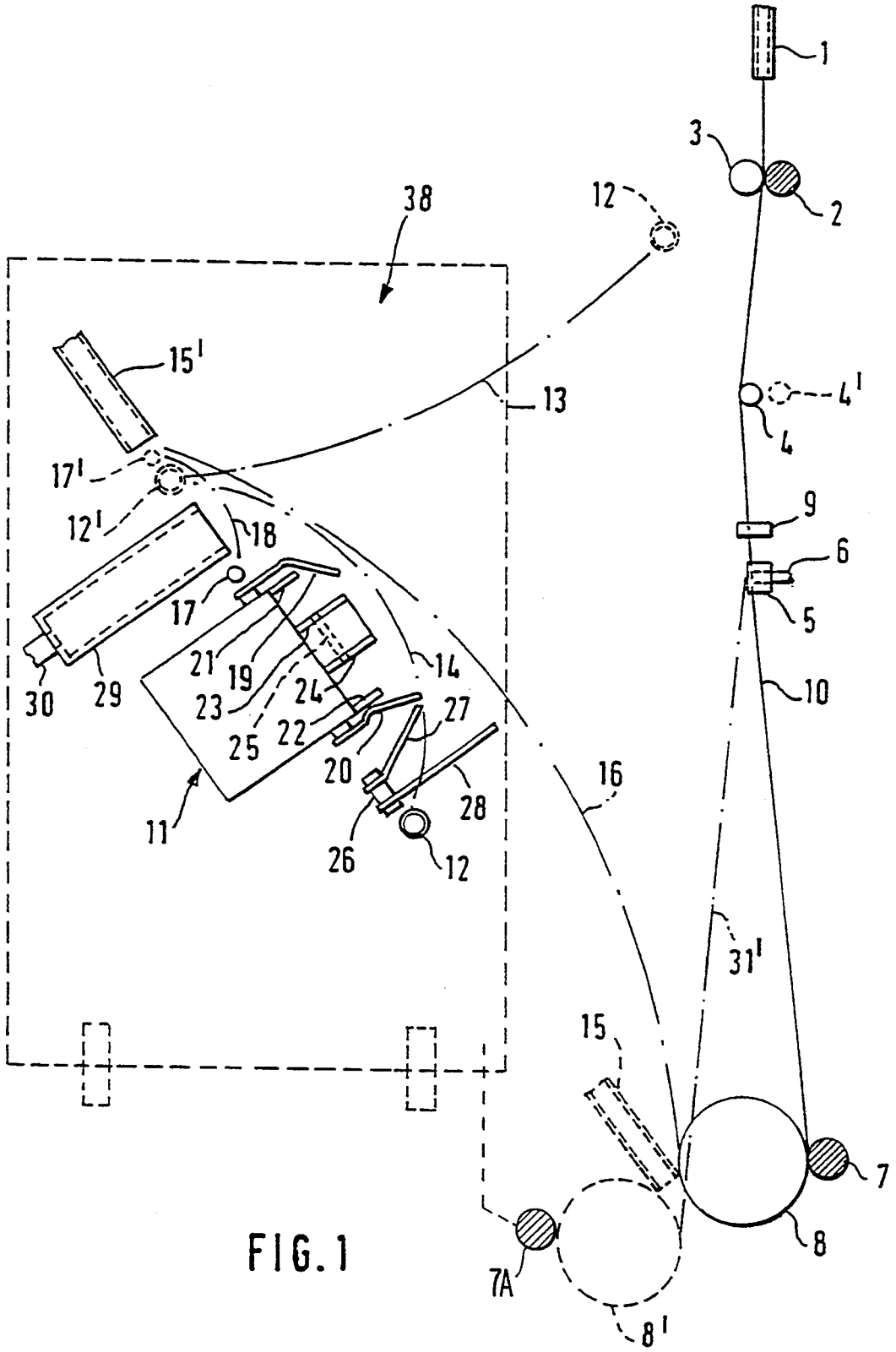
FIG. 1 is a cross-sectional schematic view of a part of a spinning unit of a spinning machine and of a part of a movable servicing apparatus which becomes operative at this spinning unit, constructed according to a preferred embodiment of the present invention.

The spinning machine shown in the drawings has a plurality of units for producing a double yarn which are arranged in a row at least on one side of the machine. The spinning units are constructed, for example, corresponding to the design of DE-A 36 34 464. Two yarn components respectively are prestrengthened by means of pneumatic false-twisting, and as a double yarn 10, are wound onto a spool 8. Each spinning unit comprises two spinning elements 1, particularly pneumatic false-twisting nozzles, which are followed by guiding elements which are not shown for the guiding-together of the spun yarn components to form a double yarn 10. The double yarn 10 is withdrawn by means of a withdrawal device which comprises a drivable shaft extending in the longitudinal direction of the machine and one pressure roller 3 respectively. Between the wind-up shaft 7 which drives the spool package 8 and extends in the longitudinal direction of the machine and the withdrawal device 2, 3, additional elements are arranged which are shown only partly. A cross-winding device which is not shown is situated directly in the area of the spool package and places the double yarn 10 crosswise on the spool package 8. The resulting different paths are compensated by a compensating device 4 in such a manner that no unacceptable tension peaks are created. The compensating device 4 can be moved between position 4 and 4'. In addition, a yarn detector 9 is arranged in this area which responds to the breakage of both yarn components or only one yarn component of the double yarn 10 and which then calls the servicing apparatus 38. In addition, the yarn detector 9 activates a suction device 5 which is connected to a suction pipe 6 by way of a valve. When a breakage of one yarn component is determined, the spinning operation is interrupted such that the spool package 8 is lifted off the winding roller 7 (Position 8') and is also braked so that the continued winding-up is interrupted. In addition, the continued supply of fiber material to the spinning elements 1 is interrupted so that an end of the "old" yarn 31' extends from the lifted-off spool package 8' to the suction device 5.

Figure 3:
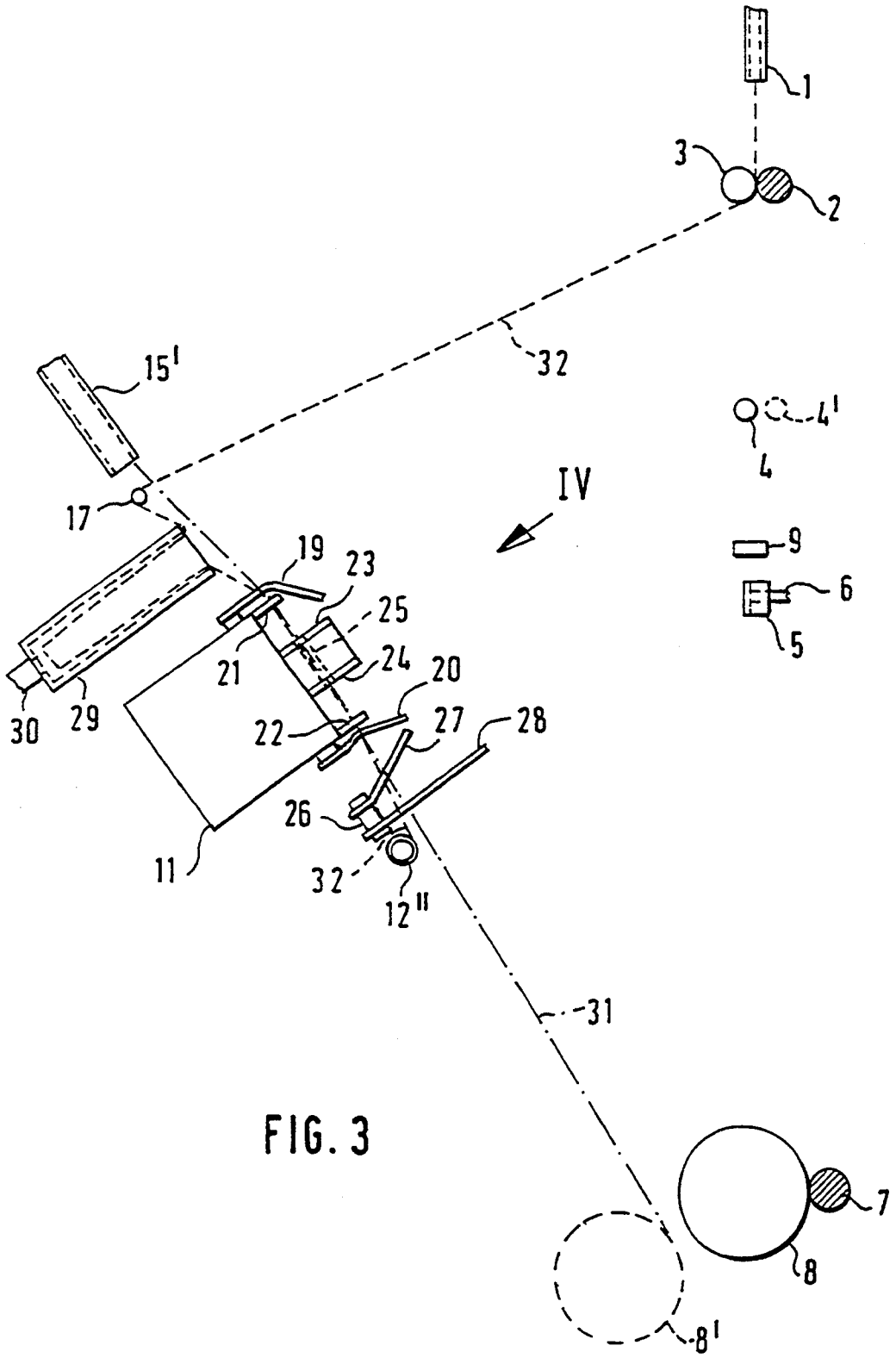
FIG. 3 is a representation similar to FIG. 2 depicting a next step in which the old yarn, in the area between the splicing device and the package spool, was brought into a position in which it can be withdrawn again later.

In the case of a yarn breakage, i.e., in the case of a breakage of one or both yarn components, the movable servicing apparatus is called by a corresponding signal of the yarn detector 9. The servicing apparatus 38 will then position itself in a known manner at the corresponding spinning unit and carry out a piecing operation. Only those elements of the servicing apparatus 38 are shown which are necessary for understanding the present invention. The servicing apparatus 38 is equipped with elements which are not shown in detail and which provide that the spinning operation is resumed at the corresponding spinning unit, i.e., that a new double yarn is spun. The newly spun yarn, i.e., a "new" yarn 32 in FIG. 3, is connected with a yarn, i.e., an "old" yarn 31 taken off the lifted-off spool package 8', in a splicing device 11. After the spliced connection is established, the yarn is again wound onto the spool package 8'. For this purpose, the servicing apparatus 38 is equipped with a corresponding drive 7A assigned to the spool package 8'. Subsequently, the servicing apparatus 38 returns the spool package 8' to the spinning unit (Position 8) so that the spinning operation is again carried out in a normal manner by the spinning unit.

Figure 4:
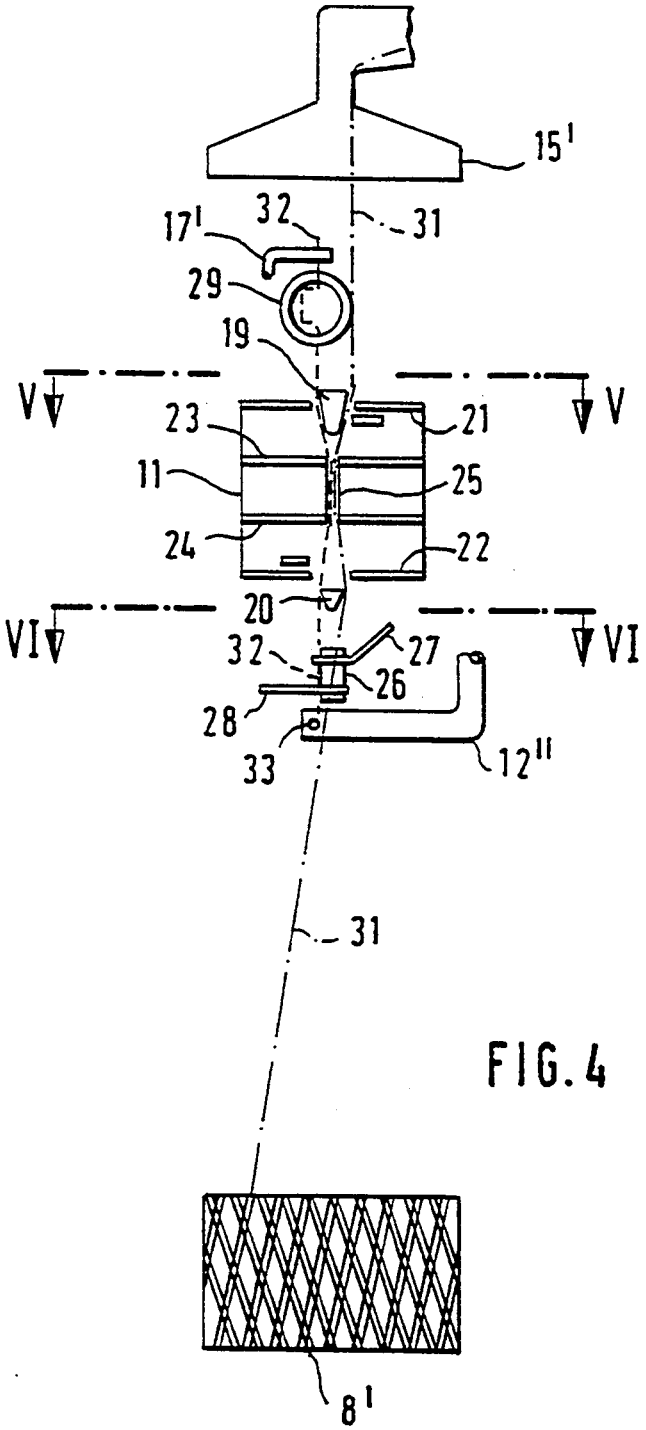
FIG. 4 is a view in the direction of Arrow IV of FIG. 3.
Figure 5:
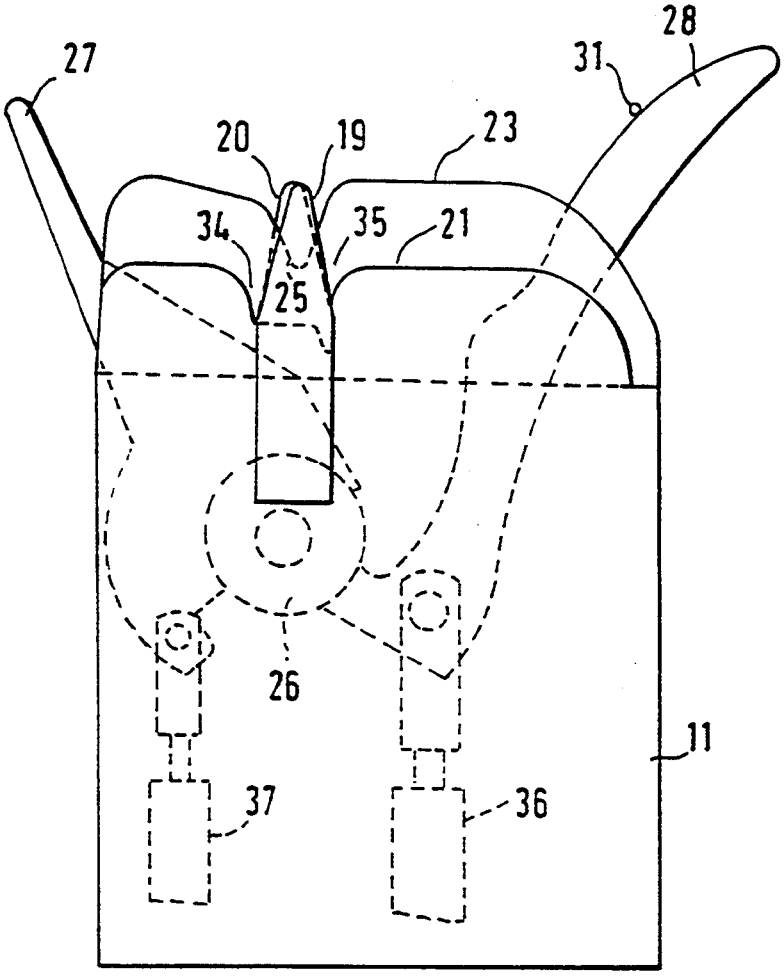
FIG. 5 is an enlarged view in the direction of Arrow V of FIG. 4.
Figure 6:
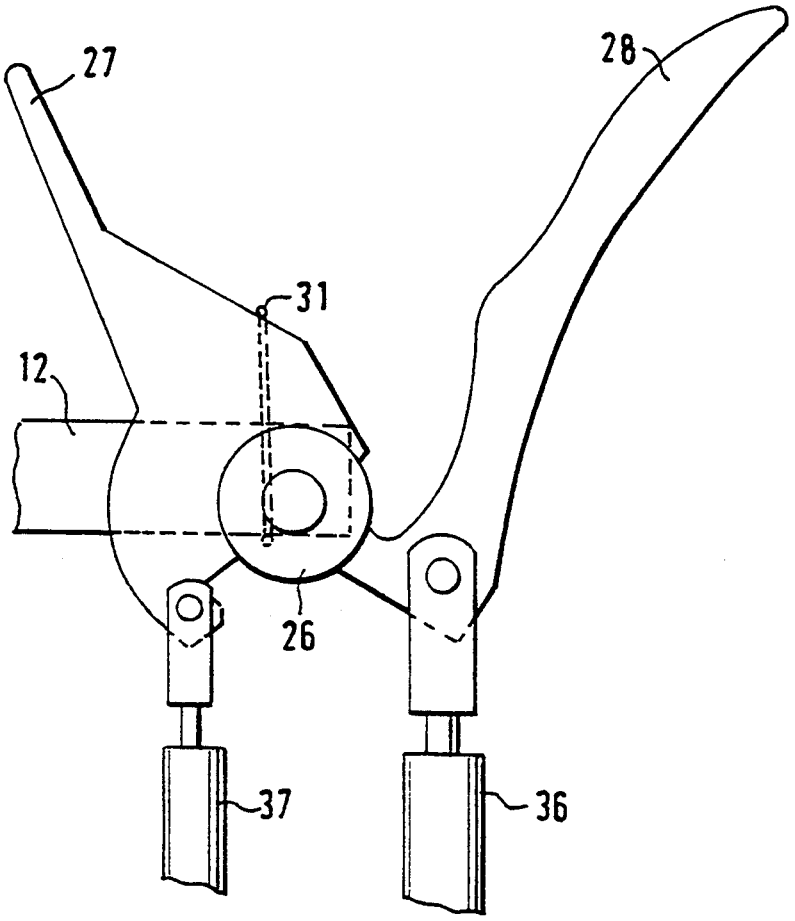
FIG. 6 is an enlarged view in the direction of Arrow VI of FIG. 4.

The splicing device 11 which is stationarily arranged in the servicing apparatus 38 comprises a splicing head with a splicing duct 25 which is aligned approximately tangentially with respect to the lifted-off spool package 8'. In this case, the splicing duct 25 is situated essentially in parallel to the operational moving direction of the double yarn 10. The servicing apparatus 38 comprises a suction nozzle 15, the width of which corresponds to the width of the spool package 8'. This suction nozzle 15 picks up the double yarn 31' and, together with it, swivels along the path 16 in such a manner that it takes up a position 15' on the side of the splicing device 11 which faces away from the spool package 8'. The old yarn 31 will then take up the position shown in FIGS. 2 to 4 in which it is placed in the splicing device 11. The splicing device 11 has guide plates 21, 22 which introduce the yarn 31 in a corresponding manner into the splicing duct 25. In this case, additional bracket-shaped guide plates 19, 20 are provided on both sides of the splicing device and separately hold the old yarn 31 and the new yarn 32 on both sides of the splicing device 11 so that the two yarns 31, 32 can be processed separately, i.e., in particular, can be clamped and cut off separately. Two guiding fingers 27, 28 are arranged between the spool package 8' and the splicing device 11, are aligned in a V-shape with respect to one another and are arranged on a common swivel shaft extending in parallel to the splicing duct 25 (FIGS. 5 and 6). The guiding fingers 27, 28, by means of swivel drives 36, 37, such as pneumatic cylinders, can be swivelled around the shaft 26. The guiding finger 28 is used mainly for securely introducing into the splicing device 11 the old yarn 31, which may take up any position in the axial direction of the spool package 8' corresponding to the cross-winding. It is actuated after the suction nozzle 15 was swivelled into position 15'. Guiding finger 27 will be actuated later, as will be explained below.

The servicing apparatus comprises another suction nozzle 12 having a suction opening 33. This suction nozzle 12 can be applied to the spinning elements 1 and picks up the newly spun double yarn 32. This suction nozzle 12 is first moved in such a manner that it places the new yarn 32 in the withdrawal device 2, 3 so that this yarn will then be withdrawn at the spinning element 1 at the operational speed. Then the suction nozzle 12 will move along the path 13 into position 12' which is situated as an extension of the splicing duct 25 of the splicing device 11 on the side facing away from the spool package 8'. In this area, a pneumatic yarn storage device 29 is located which is connected to a suction pipe 30. As soon as the suction nozzle 12 is situated in position 12', a bow-shaped yarn guiding element 17 is swivelled around the path 18 into position 17' in which it guides the new yarn 32. Subsequently, the suction nozzle 12' will be swivelled into position 12'', i.e., into a position on the opposite side of the splicing device 11, i.e., the side between the spool package 8' and the splicing device 11. As a result, the new yarn 32 is introduced into the splicing device 11, in which case the guiding plates 19, 20, 22 as well as 21, 23, 24 provide that the new yarn 32 takes up the position shown in FIG. 4. In the splicing duct 25, it will then be situated parallel to the old yarn 31 while, in the area located in front of it and behind it, it is separated from it by the guiding plates 19, 20.

Figure 2:
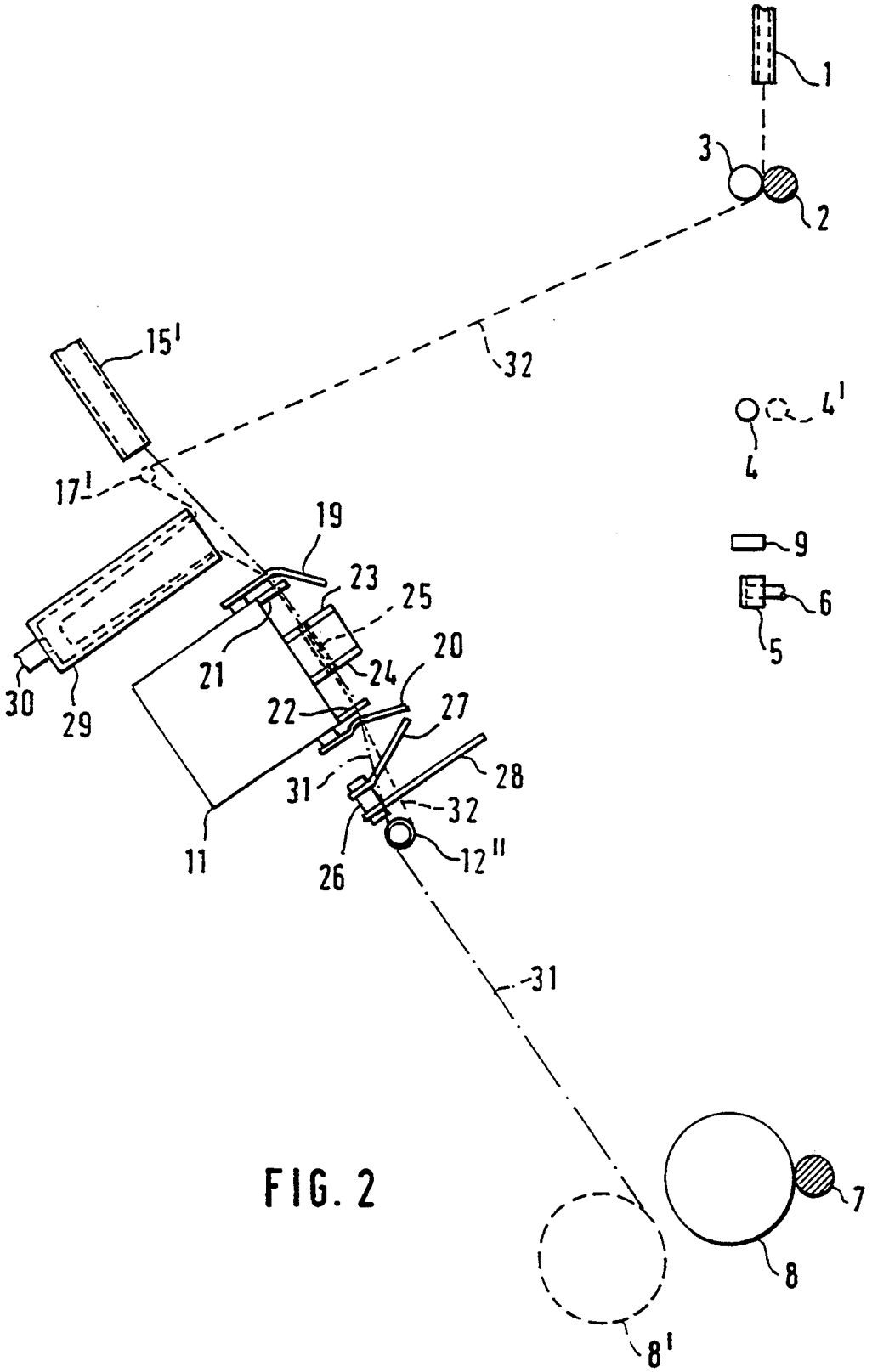
FIG. 2 is a representation similar to FIG. 1, illustrating a step where a newly spun yarn and an old yarn withdrawn from a package were placed in a splicing device.

During this movement, the new yarn 32 was also placed over the opening of the yarn storage device 29. The new yarn 32 can therefore be stopped during the subsequent splicing operation in the area of the splicing device 11, the continuously produced yarn length being sucked into the storage device 29. As shown in FIG. 2, the suction nozzle 12 has placed itself from above on the old yarn 31 and has deflected it. By means of the swivelling of the guiding finger 27 (FIG. 6), this yarn is lifted around the suction nozzle 12 which, in this case, is in position 12'', so that the yarn takes up the position according to FIG. 3. The splicing operation takes place in this position. For this purpose, the old yarn 31 is clamped, in a manner not shown in detail, between the spool package 8' and the splicing duct 25 and is cut off on the opposite side of the splicing duct and, if necessary, is processed further. The cut-off end is sucked into the suction nozzle 15' and is removed by it.

The new yarn 32 is clamped on the side of the splicing duct facing the storage device 29 and is cut off on the opposite side and, if necessary, is also processed further. The cut-off end is sucked off by the suction nozzle 12' located in position 12'. After the establishment of the spliced connection, the yarn which is now composed of the old and the new yarn 31, 32 is released and is withdrawn and wound up by the driving of the spool package 8'. As soon as the storage device 29 is empty, the spool package 8' is transferred to position 8 so that the normal spinning operation may be resumed.

As a modification of the shown embodiment, it is also contemplated to move the suction nozzle 12 which receives the new yarn 32' directly into position 12''. A modified yarn guiding element will then be provided which moves into position 17' and in the process takes along the new yarn 32 in such a manner that, on the one side, it is placed in the splicing device 11 and, on the other side, it is applied to the storage device 29.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. A spinning machine comprising:

a plurality of spinning units arranged next to one another which each have at least one spinning device for spinning a yarn, one withdrawing device for withdrawing a spun yarn, and one winding device for winding the spun yarn onto a spool package, and a movable servicing apparatus which can be applied to the individual spinning units for piecing, said movable servicing apparatus including:

a splicing device for connecting a newly spun new yarn with an old yarn taken off the spool package, said splicing device including a splicing duct having an axis aligned with the yarns during splicing and extending substantially along a tangent of the spool package, a new yarn pick-up device for picking up the new yarn and for placing it in the splicing device;

an old yarn pick-up device for picking up the old yarn and placing it in the splicing device, a yarn storage device arranged approximately as an extension of the splicing duct and including a yarn storage opening facing the splicing travel path of new yarn being produced during splicing, said splicing travel path being spaced from the normal spinning path, and a new yarn guiding element which is operable only during splicing operations and serves to guide the new yarn to travel adjacent and into the yarn storage opening during splicing operations.

2. A spinning machine according to claim 1, wherein said new yarn pick-up device is movable sequentially through first, second and third positions during transfer of new yarn to the splicing device, said first position being adjacent the spinning unit withdrawing device, said second position being at a side of the yarn storage device which is opposite the splicing device, and said third position being at a side of the splicing device which is opposite the yarn storage device.

3. A spinning machine according to claim 2, wherein said new yarn guiding element is movable between first and second positions at opposite sides of the new yarn pick-up device such that the new yarn guiding element, in its second position, engages the new yarn held by the new yarn pick-up device at a position upstream of the yarn storage device while the new yarn pick-up device is disposed to hold the new yarn in the splicing device.

4. A spinning machine according to claim 2, wherein said new yarn guiding element is movable between a first position at a side of the yarn storage device adjacent the splicing device and a second position at an opposite side of the yarn storage device.

5. A spinning machine according to claim 1, wherein said new yarn guiding element is movable between a first position at a side of the yarn storage device adjacent the splicing device and a second position at an opposite side of the yarn storage device.

6. A spinning machine according to claim 1, wherein the servicing apparatus includes old yarn guiding elements for guiding the old yarn withdrawn from the spool package, said old yarn guiding elements being between the spool package and the splicing device when the servicing apparatus is in an operating position at a spinning unit.

7. A spinning machine according to claim 6, wherein the old yarn guiding elements include two guiding fingers which are arranged essentially in a V-shape on a common shaft extending in parallel with respect to the splicing duct and a driving element for swivelling the guiding fingers.

8. A spinning machine according to claim 7, wherein the new yarn pick-up device includes a suction nozzle which can be moved to the splicing device from the spinning device.

9. A spinning machine according to claim 7, wherein the old yarn pick-up device includes a suction nozzle which can be moved from the spool package to an opposite side of the splicing device.

10. A spinning machine according to claim 6, wherein the new yarn pick-up device includes a suction nozzle which can be moved to the splicing device from the spinning device.

11. A spinning machine according to claim 6, wherein the old yarn pick-up device includes a suction nozzle which can be moved from the spool package to an opposite side of the splicing device.

12. A spinning machine according to claim 1, wherein the new yarn pick-up device includes a suction nozzle which can be moved to the splicing device from the spinning device.

13. A spinning machine according to claim 12, wherein the old yarn pick-up device includes a suction nozzle which can be moved from the spool package to an opposite side of the splicing device.

14. A spinning machine according to claim 1, wherein the old yarn pick-up device includes a suction nozzle which can be moved from the spool package to an opposite side of the splicing device.

15. A spinning machine according to claim 1, wherein each of said spinning units include pneumatic false twisting elements for producing a double yarn.

16. A movable servicing apparatus for performing servicing operations at respective spinning units of the type producing new yarn and winding the same on a yarn package, comprising:

a splicing device for connecting a newly spun new yarn with an old yarn taken off the spool package, said splicing device including a splicing duct having an axis aligned with the yarns during splicing and extending substantially along a tangent of the spool package, a new yarn pick-up device for picking up the new yarn and for placing it in the splicing device;

an old yarn pick-up device for picking up the old yarn and placing it in the splicing device, a yarn storage device arranged approximately as an extension of the splicing duct and including a yarn storage opening facing the splicing travel path of new yarn being produced during splicing, said splicing travel path being spaced from the normal spinning path, and a new yarn guiding element which is operable only during splicing operations and serves to guide the new yarn to travel adjacent and into the yarn storage opening during splicing operations.

17. A movable servicing apparatus according to claim 16, wherein said new yarn pick-up device includes apparatus for moving the new yarn from the side of the yarn storage device facing away from the splicing duct to the opposite side of the splicing duct while the new yarn being produced is held by the new yarn guiding element and the yarn storage device.

18. A movable servicing apparatus according to claim 17, comprising guiding elements of the servicing apparatus for the old yarn withdrawn from the spool package which can be moved transversely to the splicing duct, said guiding elements being provided between the spool package and the splicing device when the servicing apparatus is in an operating position at a spinning unit.

19. A movable servicing apparatus according to claim 18, wherein said guiding elements include two guiding fingers which are arranged essentially in a V-shape on a common shaft extending in parallel with respect to the splicing duct and can be swivelled by means of driving elements.

20. A movable servicing apparatus according to claim 19, wherein the old yarn pick-up device includes a suction nozzle for gripping the old yarn at the yarn package.

21. A movable servicing apparatus according to claim 20, wherein the suction nozzle of the old yarn pick-up device is movable from the yarn package to the side of the splicing device which faces away from the yarn package.

22. A movable servicing apparatus according to claim 17, wherein the new yarn pick-up device includes a suction nozzle for gripping the new yarn.

23. A movable servicing apparatus according to claim 22, wherein the old yarn pick-up device includes a suction nozzle for gripping the old yarn at the yarn package.

24. A movable servicing apparatus according to claim 17, wherein the old yarn pick-up device includes a suction nozzle for gripping the old yarn at the yarn package.

25. A movable servicing apparatus according to claim 24, wherein the suction nozzle of the old yarn pick-up device is movable from the yarn package to the side of the splicing device which faces away from the yarn package.

26. A movable servicing apparatus according to claim 16, wherein the spinning units are of the type producing a double yarn of side-by-side prestrengthened yarn components which are to be subsequently twisted to form final yarn, said yarn splicing device including apparatus for splicing said double yarn.

* * * * *